US005531074A

United States Patent [19]

Katagiri et al.

[11] Patent Number: 5,531,074

[45] Date of Patent: Jul. 2, 1996

[54] ELECTRONIC DEVICE FREEZED BY INTERMITTENTLY DRIVEN REFRIGERATOR

[75] Inventors: Masaki Katagiri, Hitachinaka; Yoshito Taguchi, Tokorozawa; Toshio Uchida, Tanashi, all of Japan

[73] Assignees: Japan Atomic Energy Research Institute; Sumitomo Heavy Industries, Ltd., both of Tokyo, Japan

[21] Appl. No.: 397,843

[22] Filed: Mar. 2, 1995

[30] Foreign Application Priority Data

Mar. 9, 1994 [JP] Japan ..... 6-038379

[51] Int. Cl.[6] ..... F25B 9/00; G01J 5/02

[52] U.S. Cl. ..... 62/6; 62/228.1; 250/352

[58] Field of Search ..... 62/6, 228.1, 51.1; 250/352

[56] References Cited

U.S. PATENT DOCUMENTS

| | | | |
|---|---|---|---|
| 3,188,830 | 6/1965 | Cowans | 250/352 X |
| 3,421,331 | 1/1969 | Webb | 62/6 |
| 3,430,455 | 3/1969 | Stuart et al. | 62/6 X |
| 3,445,659 | 5/1969 | Guimento et al. | 250/352 |
| 3,807,188 | 4/1974 | Lagodmos | 250/352 X |
| 4,361,011 | 11/1982 | Callender et al. | 62/228.1 X |
| 5,018,357 | 5/1991 | Livingstone et al. | 62/6 |
| 5,032,772 | 7/1991 | Gully et al. | 62/6 X |
| 5,088,288 | 2/1992 | Katagishi et al. | 62/6 |
| 5,113,662 | 5/1992 | Fujii et al. | 62/6 |
| 5,119,071 | 6/1992 | Takezawa et al. | 62/6 X |
| 5,136,851 | 8/1992 | Kotaka | 62/6 |
| 5,156,005 | 10/1992 | Redlich | 62/6 |
| 5,177,971 | 1/1993 | Kiyota | 62/6 |
| 5,197,295 | 3/1993 | Pundak | 62/6 |
| 5,214,922 | 6/1993 | Dopazo | 62/6 |
| 5,245,830 | 9/1993 | Aubrun et al. | 62/6 |
| 5,255,521 | 10/1993 | Watanabe | 62/6 |
| 5,385,010 | 1/1995 | Horn | 62/6 |
| 5,392,607 | 2/1995 | Wu | 62/6 |
| 5,412,951 | 5/1995 | Wu | 62/6 |

*Primary Examiner*—Christopher Kilner

*Attorney, Agent, or Firm*—Frishauf, Holtz, Goodman, Langer & Chick

[57] ABSTRACT

A detecting device having: a compressor driven by an electric signal for supplying and recovering He gas at an operation cycle of 10 Hz to 400 Hz; a He gas refrigerator for transferring the He gas to and from the compressor and expanding the tie gas to generate cold; driving power supply means for intermittently supplying a driving power to the compressor at a certain interval; and a detector to be cooled by the He gas refrigerator.

19 Claims, 16 Drawing Sheets

ELECTRONIC DEVICE FREEZED BY INTERMITTENTLY DRIVEN REFRIGERATOR

BACKGROUND OF THE INVENTION

1. Field of the Invention

The present invention relates to an electronic device, and more particularly to an electrically refrigerated electronic device in which an electronic device is freezed by using electricity.

2. Description of the Related Art

For example, radiation detecting semiconductor device for detecting radioactive rays with a cooled semiconductor detecting element are widely used not only for measuring radioactive rays such as gamma rays and X-rays radiated at nuclear reactor facilities but also in the fields of radiation instrumentation such as nuclear physics, astro-physics, and nuclear chemistry. Cooling is an effective means for reducing noises in electronic devices which deal with weak signals. Cooling is generally performed by using refrigerant such as liquid nitrogen.

FIG. 14 shows a conventionally used radiation detecting semiconductor device of a liquid nitrogen type. A refrigerant vessel 102 disposed in a vacuum housing 109 contains liquid nitrogen 103. A cooling rod 104 extends from the side wall of the cooling vessel 102 and enters the inside of a pipe 108 mounted on the side wall of the vacuum housing 109 and passes through a flange 107. A radiation detecting semiconductor element 101 is mounted on the tip end of the cooling rod 104. A vacuum container 105 is hermetically mounted on the flange 107 and constitutes a vacuum chamber together with the vacuum housing 109. The cooling rod 104 and radiation detecting semiconductor element 101 are in the vacuum container. The radiation detecting semiconductor element 101 is cooled by the cooling rod 104 approximately down to the liquid nitrogen temperature.

A preamplifer 106 is installed on the side wall of the pipe 108. A radiation detection signal outputted from the radiation detecting semiconductor element 101 is inputted via lead wires L to the preamplifier 106. The preamplifier 106 amplifies the inputted radiation detection signal and outputs it to a radiation signal detector circuit of a later stage.

FIG. 15 shows a conventional radiation detecting semiconductor device using a closed cycle tie cooler. A compressor 110 is connected via pipes 111 to an adiabatic compression part 112. A cylinder 116 extends in a pipe 113 connected to the adiabatic compression part 112. A radiation detecting semiconductor element 101 is mounted via a buffer 115 on an adiabatic expansion part (cooling part) 114 at an end of the cylinder 116.

A vacuum container 105 is mounted via a flange to the end portion of the pipe 113. The radiation detecting semiconductor element 101, buffer 115, and cylinder 116 are hermetically housed in the vacuum container 105. Compressed He gas is allowed to adiabatically expand in the cooling part 114 so that it is cooled. The radiation detecting semiconductor element 101 is also cooled via the buffer 115.

A preamplifier 106 is mounted on the side wall of the pipe 113. Similar to the device shown in FIG. 14, the preamplifier 106 amplifies a radiation detection signal and outputs the amplified signal to a radiation signal detector circuit of a later stage.

The radiation detecting semiconductor device of a liquid nitrogen cooling type shown in FIG. 14 uses liquid nitrogen for cooling a radiation detecting semiconductor element. It is necessary therefore to prepare liquid nitrogen for the detection of radiation. It is thus difficult to use the detecting device with ease, and the usable place of the device is restricted. A cooling vessel is a requisite for using the device so that it is difficult to make it compact.

Vibrations of the cooling part 114 of the closed cycle lie cooler shown in FIG. 15 are inevitable because of its mechanical structure. Vibrations of the cooling part 114 generate microphonic noises. These microphonic noises may become a cause of lowering energy resolution which is an important performance of the radiation detecting device.

The frequency range of microphonic noises extends near to the frequency of a radiation detection signal. It is therefore difficult to eliminate them by using only a signal processing technique. In order to alleviate the influence of microphonic noises, the buffer 115 is inserted between the cooling section 114 and radiation detecting semiconductor element 101. It is necessary to cool also the buffer 115 during the radiation measurement so that a large cooling capacity is needed.

SUMMARY OF THE INVENTION

It is an object of the present invention to provide an electrically cooled electronic device with reduced noise.

It is another object of the present invention to provide an electrically cooled radiation detecting semiconductor device which requires no liquid nitrogen, is compact and has a high energy resolution.

According to one aspect of the present invention, there is provided a detecting device including: a compressor driven by an electric signal for supplying and recovering He gas at an operation cycle of 10 Hz to 400 Hz; a He gas refrigerator for transferring the He gas to and from the compressor and expanding the He gas for generating cold; driving power supply means for intermittently supplying a driving power to the compressor at a certain interval; and a detector to be cooled by the He gas refrigerator.

According to another aspect of the present invention, there is provided a detecting device including: a Stirling refrigerator for expanding He gas at an operation cycle of 10 Hz to 400 Hz; drive means for reciprocally driving a displacer of the Stirling refrigerator; and a driving power source for intermittently supplying a driving power to the drive means.

According to another aspect of the present invention, there is provided a detecting method wherein a detector is mounted on a cooled part of a refrigerator having a movable part to be forcibly driven, the detector outputting a detection signal corresponding to an externally inputted object to be measured, the detector is cooled, and the detection signal outputted from the detector is analyzed, the method including the steps of: driving the refrigerator and cooling the detector; stopping driving the refrigerator and analyzing the detection signal outputted from the detector; and repeating the cooling step and the analyzing step at a certain periodical cycle.

Vibrations of the cooled part can be reduced by intermittently supplying a driving power to the compressor more than the ease of always supplying the driving power thereto. If radioactive rays are to be detected by mounting a radiation detecting semiconductor element on the cooled part, microphonic noises in a detection signal from the radiation detecting semiconductor element can be reduced. The energy resolution of radiation detection can therefore be improved.

An intermittent supply of a driving power forms a period while a position or positions are positively driven and a period while they are almost still at a neutral position. During the period while the position or pistons are almost still, less microphonic noises are generated.

By retrieving and analyzing a radiation detection signal only during the period while microphonic noises are less, radioactive rays can be detected with less influence of microphonic noises. The energy resolution of radiation detection can therefore be improved further.

If a displacer of a Stirling refrigerator is to be directly driven, vibrations of the cooled part can be reduced by intermittently driving the displacer.

DESCRIPTION OF THE PREFERRED EMBODIMENTS

Figure 1:
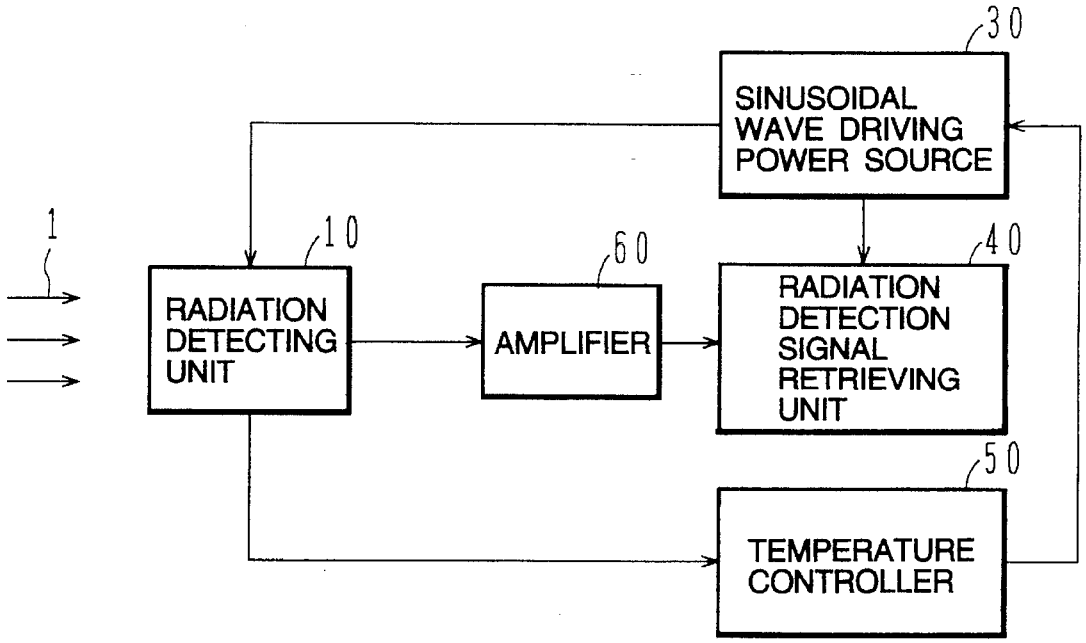
FIG. 1 is a block diagram of a radiation detecting device according to an embodiment of the invention.

The outline of a radiation detecting semiconductor device according to an embodiment of the invention will be described with reference to FIG. 1. FIG. 1 is a block diagram of the radiation detecting device according to the embodiment of the invention. The radiation detecting device is formed of a radiation detecting unit 10, a sinusoidal wave driving power source 30, a radiation detection signal retrieving unit 40, a temperature controller 50, and an amplifier 60.

The radiation detecting unit 10 includes a radiation detecting semiconductor element and a Stirling refrigerator. Electricity for driving the Stirling refrigerator is supplied from the sinusoidal wave driving power source 30 to the radiation detecting unit 10.

As radioactive rays are incident on the radiation detector unit 10, this unit sends radiation detection signals to the amplifier 60. The amplifier 60 amplifies a radiation detection signal and outputs it to the radiation detection signal retrieving unit 40.

A timing signal for picking up a radiation detection signal is supplied from the sinusoidal wave driving power source 30 to the radiation detection signal retrieving unit 40. In response to this timing signal, the radiation signal retrieving unit 40 retrieves a radiation detection signal and processes it.

Temperature data of the radiation detecting semiconductor element of the radiation detecting unit 10 is supplied to the temperature controller 50. The temperature controller 50 compares a temperature of the radiation detecting semiconductor element with a preset reference temperature, and in accordance with the comparison result, outputs a control signal to the sinusoidal wave driving power source 30. In accordance with this control signal, the sinusoidal wave driving power source 30 controls a driving power for the Stirling refrigerator to maintain the temperature of the radiation detecting semiconductor element at the reference temperature.

The structure and function of each constituent element will be described.

Figure 2A:
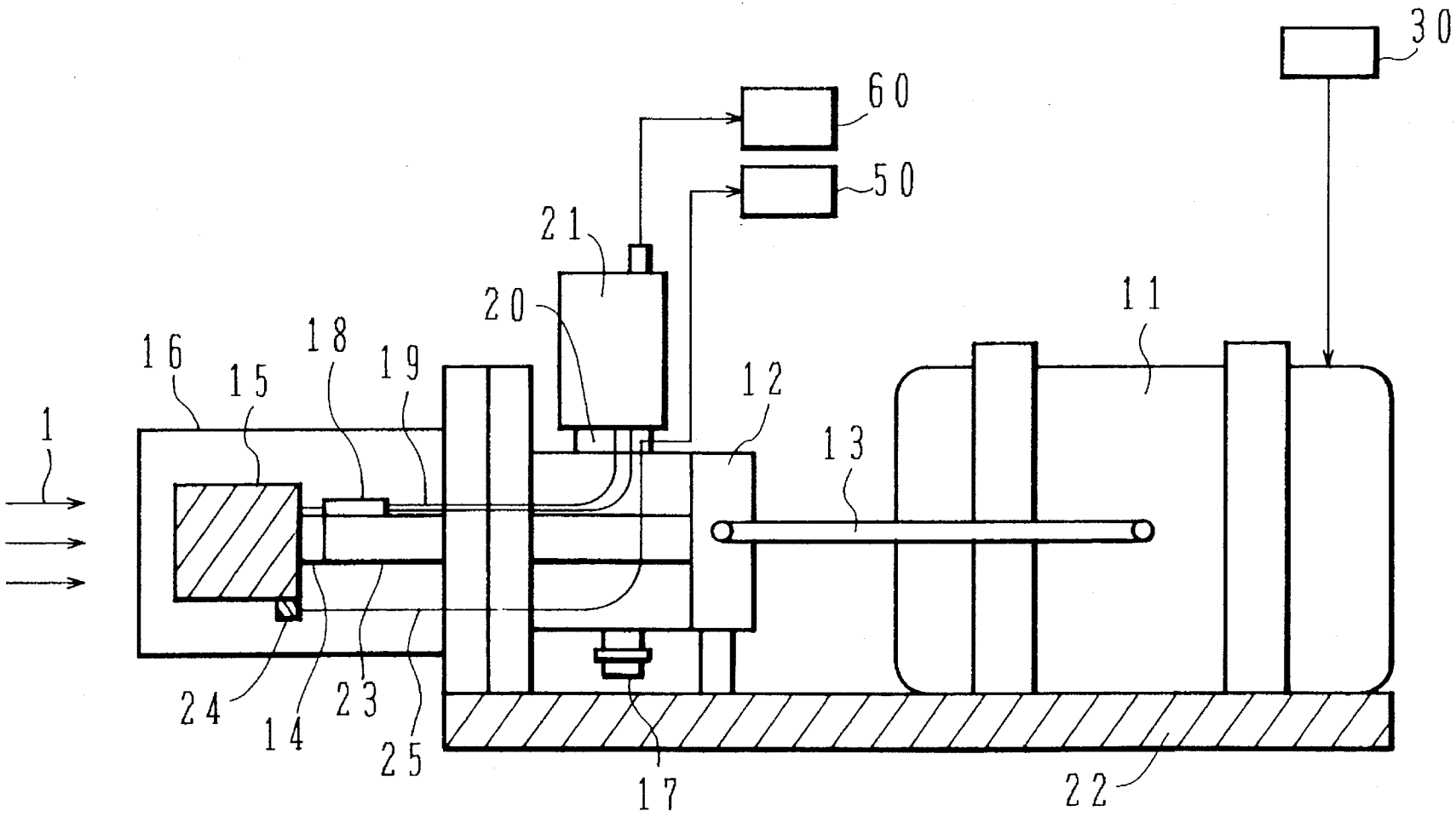
FIG. 2A is a schematic diagram of a radiation detecting part of the radiation detecting device shown in FIG. 1.

FIG. 2A is a schematic diagram showing the radiation detecting unit 10 shown in FIG. 1. A driving power is supplied From the sinusoidal wave driving power source 30 to a compressor 11. The compressor 11 is connected via a connection pipe 13 to an isothermal compression part 12, supplies helium gas compressed at a constant cycle, and recovers helium gas. Compressed or expanded helium gas is transferred via the connection pipe 13 between the compressor 11 and isothermal compression part 12.

A hollow cylinder 23 having a cooling part 14 at its end portion is connected to the isothermal compression part 12. A piston (displacer) having a heat regenerative function is inserted into the cylinder 23, and reciprocally moves in the right and left directions as viewed in FIG. 2A to change the pressure of, and shift the phase of, compressed helium introduced to the isothermal compression part 12.

A radiation detecting semiconductor element 15 is mounted on a cooling part 14. The radiation detecting semiconductor element 15 is a Ge or Si detecting element. The radiation detecting semiconductor element 15, cooling part 14, and cylinder 23 are accommodated in a vacuum chamber 16. A vacuum valve 17 is mounted on the vacuum chamber 16, enabling evacuation of the inside of the chamber 16 to a high vacuum degree.

A preamplifier front stage circuit 18 is mounted on the cylinder 23 near the cooling part 14, and electrically connected to the radiation detecting semiconductor element 15. Signal lines and circuit wirings 19 of the preamplifier front stage circuit 18 are connected via a hermetic seal 20 to a preamplifier back stage circuit 21 mounted on the outside of the vacuum chamber 16. A signal outputted from the preamplifier back stage circuit 21 is supplied to an amplifier 60.

A temperature sensor 24 is mounted on the radiation detecting semiconductor element 15. Signal lines 25 of the temperature sensor 24 are guided through the hermetic seal 20 to the outside of the vacuum chamber 16, and connected to the temperature controller 50. The vacuum chamber 16, isothermal compression part 12, and compressor 11 are fixed to a support base 22.

The radiation detecting semiconductor element 15 used is a closed end type high purity Ge detector which has a diameter of 32 mm, a length of 20 mm, and a volume of 15 $cm^3$. The Stirling refrigerator used is driven by a linear motor having a maximum operating AC voltage and current ratings of 11 V and 6.5 A, and has a cooling capacity of 1.5 W (at 80 K).

Figure 2B:
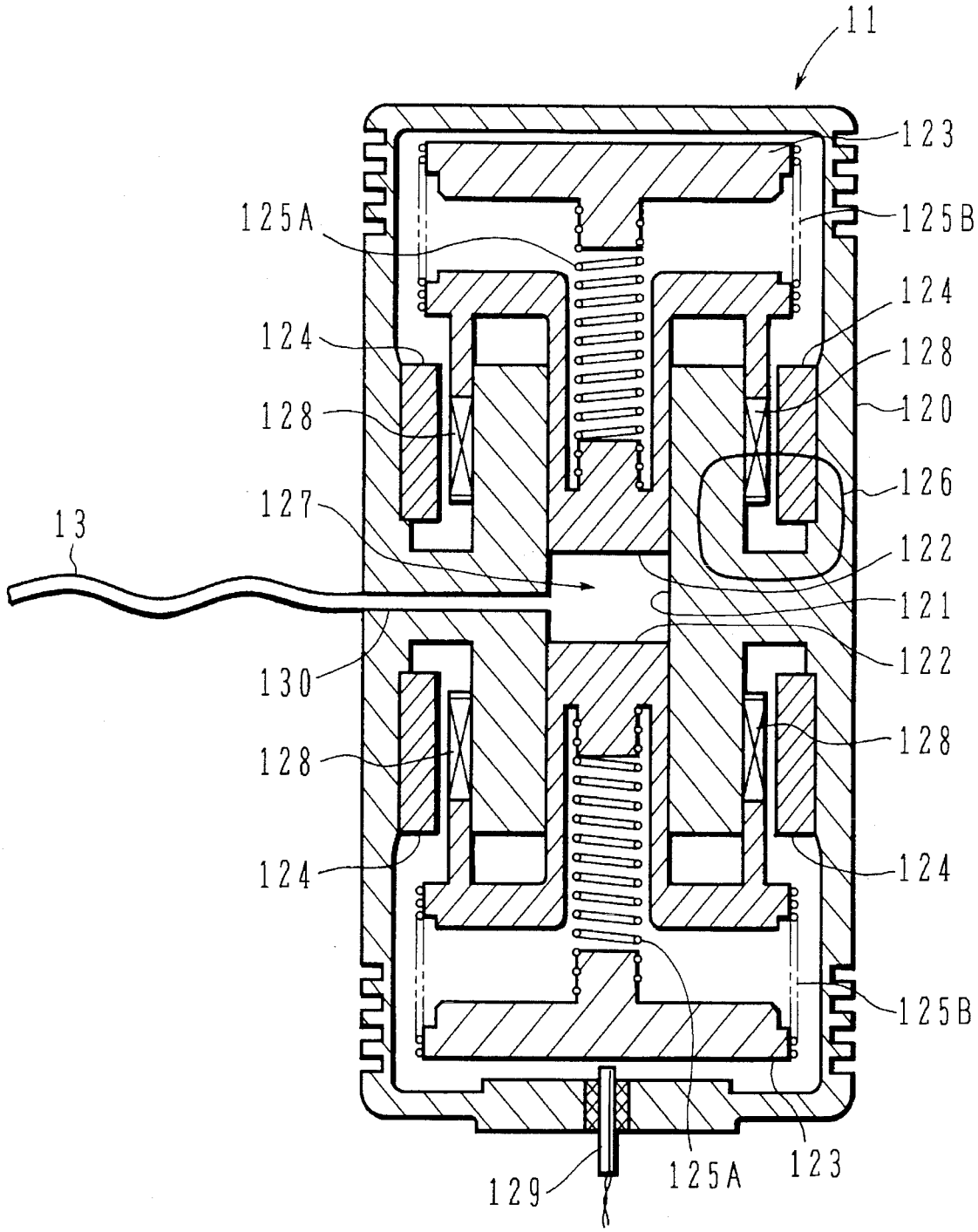
FIG. 2B is a cross sectional view of a compressor shown in FIG. 2A.

FIG. 2B is a schematic cross sectional view of the linear-motor driven compressor. The compressor 11 has a cylindrical outer housing 120 in which a cylinder 121, pistons 122, spring seats 123, permanent magnets 124, a small diameter coil spring 125A, and a large diameter coil spring 125B are accommodated. The cylinder 121 is fixed to the outer housing 120 at the central outer peripheral area of the cylinder 121. Two tubular gaps are formed between the outer peripheral area of the cylinder 121 and the inner peripheral area of the outer housing 120. The two pistons 122 are inserted in the cylinder 121 and face each other to define a compression space 127 which communicates with the connection pipe 13 via a gas flow path 130.

The cylindrical permanent magnets 124 are disposed in the two tubular gaps formed between the cylinder 121 and outer housing 120, and mounted on the inner peripheral area of the outer housing 120. A magnetic circuit 126 is formed by the permanent magnet 124, cylinder 121, outer housing 120, and gap between the permanent magnet 124 and cylinder 121. A cylindrical movable coil 128 is disposed in the gap between the permanent magnet 124 and cylinder 121. The movable coil 128 is fixedly mounted on the piston 122.

The spring seats 123 are fixed to the opposite inner faces of the outer housing 120. The piston 122 is assembled relative to the spring seat 123 by the small and large diameter coil springs 125A and 125B, and elastically supported in the axial direction. Current is supplied via a power source terminal 129 to the movable coil 128.

When current flows through the movable coil 128, the coil 128 receives a force in the axial direction by the magnetic field generated in the magnetic circuit 126. Therefore, when alternating current flows through the movable coil 128, the piston 122 can reciprocally move in the axial direction. As the two pistons 122 are driven alternately in the opposite directions, the volume of the compression space 127 periodically changes. When the volume of the compression space 127 reduces, compressed gas is supplied to the connection pipe 13, whereas when the volume increases, the gas in the connection pipe 13 is drawn.

In the above manner, the compressor 11 can supply gas the pressure of which is pulsating, to the connection pipe 13. In this case, the two pistons 122 are driven in the opposite directions and the center of gravity thereof does not change. Therefore, vibrations of the whole compressor 11 can be reduced.

The operation of the radiation detecting part will be described with reference to FIG. 2A. When a driving power is supplied from the sinusoidal wave driving power source 30, the pistons of the compressor 11 are directly driven in linear reciprocation. As the pistons are linearly driven in one directions, helium gas is compressed and supplied via the connection pipe 13 to the compression part. As the pistons are linearly driven in the other directions, helium gas is recovered from the expansion part. In this manner, introduction and exhaust of helium gas into and from the isothermal compression part 12 are periodically repeated.

The piston in the cylinder 23 reciprocally moves in the right and left directions at a constant phase shift from the introduction and exhaust of helium gas into and from the isothermal compression part 12. Helium gas in the space of the cylinder on the left side of the piston expands and cools the cooling part 14.

As radioactive rays are incident on the radiation detecting semiconductor element 15, radiation detection signals are generated and inputted to the preamplifier front stage circuit 18. The radiation detection signal is amplified by the preamplifier front and back stage circuits 18 and 21 and supplied to the amplifier 60.

A temperature of the radiation detecting semiconductor element 15 is converted into an electrical signal by the temperature sensor 24, and supplied via the signal lines 25 to the temperature controller 50.

Figure 3:
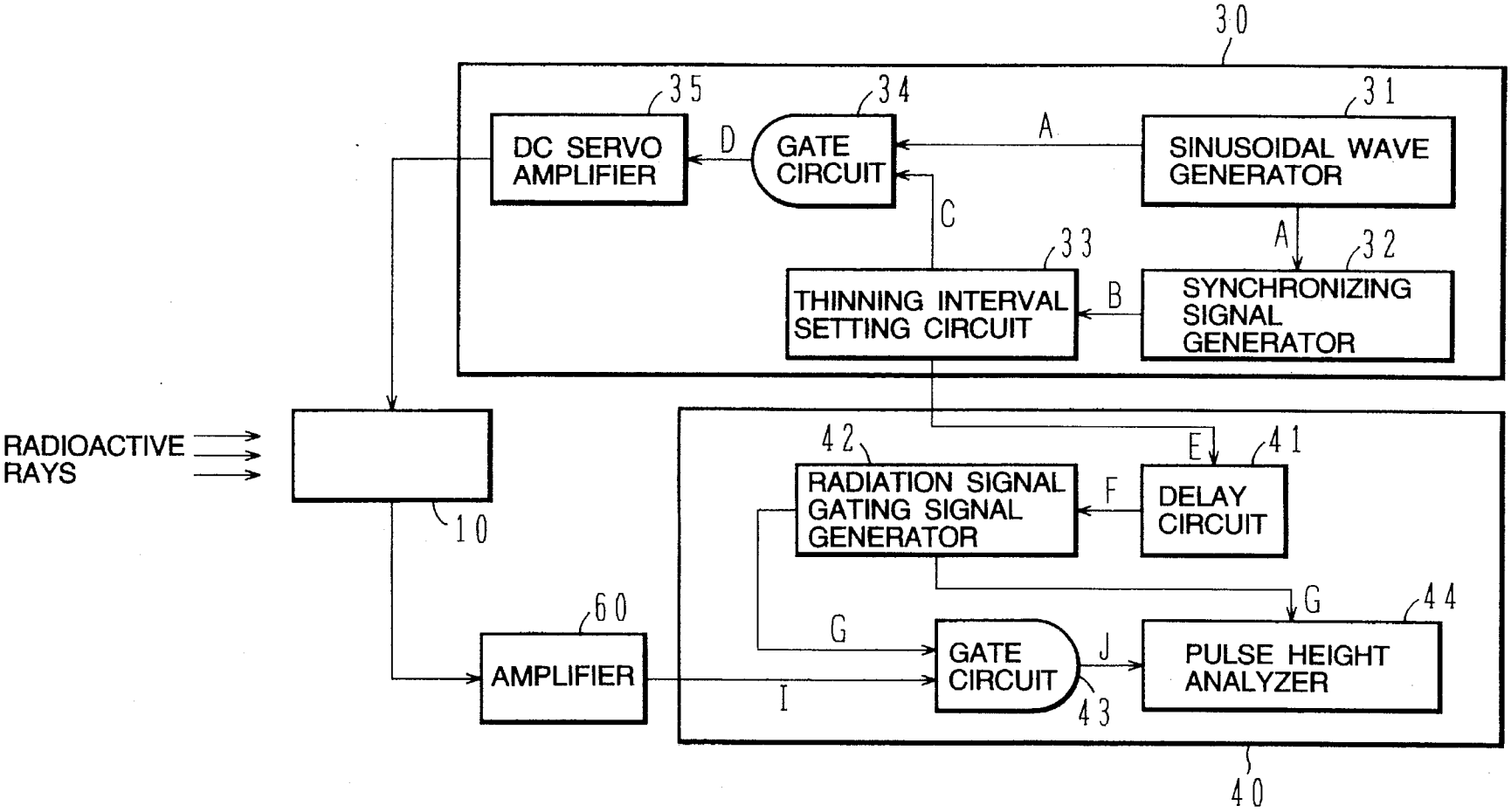
FIG. 3 is a block diagram of a sinusoidal wave driving power source and a radiation detection signal retrieving part of the radiation detecting device shown in FIG. 1.

FIG. 3 is a block diagram showing the sinusoidal wave driving power source 30 and radiation detection signal retrieving unit 40 shown in FIG. 1.

The sinusoidal wave driving power source 30 is constituted by a sinusoidal wave generator 31, a synchronizing signal generator 32, a thinning interval setting circuit 33, a gate circuit 34, and a DC servo amplifier 35. The radiation detection signal retrieving unit 40 is constituted by a delay circuit 41, a radiation signal gating signal generator 42, a gate circuit 43, and a pulse height analyzer 44. In the following, the function of the sinusoidal wave driving power source 30 and radiation detection signal retrieving unit 40 will be described with reference to FIG. 4.

Figure 4:
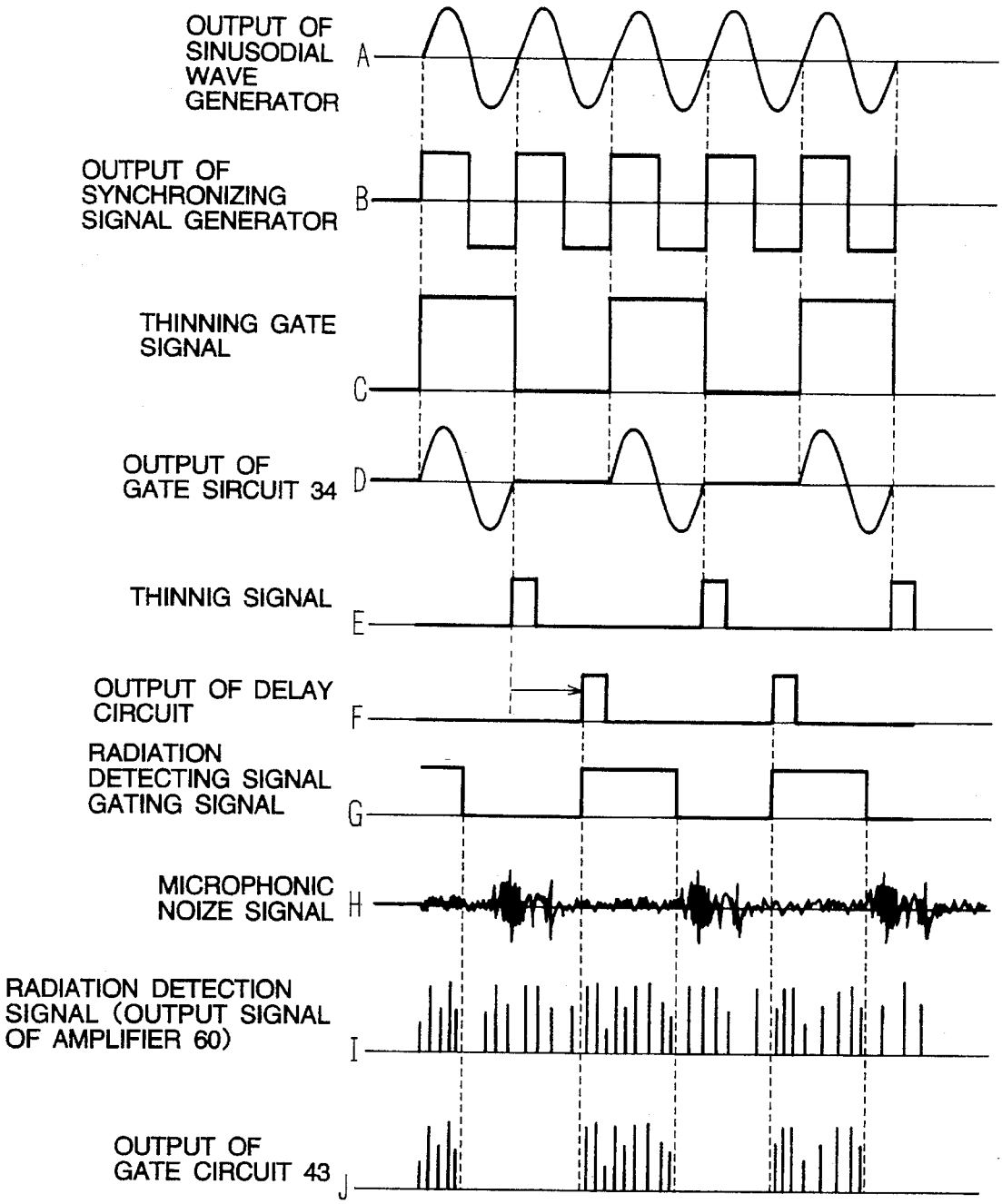
FIG. 4 is a timing chart explaining the operations of the sinusoidal wave driving power source and the radiation detection signal retrieving unit shown in FIG. 3.

FIG. 4 is a timing chart showing signal waveforms at various parts of the sinusoidal wave driving power source 30 and radiation detection signal retrieving unit 40. The sinusoidal wave generator 31 generates a sinusoidal wave A having a predetermined frequency, and supplies it to the synchronizing signal generator 32. The synchronizing signal generator converts an inputted sinusoidal wave into a rectangular wave B, and supplies it to the thinning interval setting circuit 33.

The thinning interval setting circuit 33 generates a thinning gate signal C having a low level at one of two cycles of the inputted rectangular wave B and a high level at the other cycle.

In the timing chart of FIG. 4, a low level is set to one of two cycles. A low level may be set to consecutive n cycles of 2n cycles. For example, a high level is set to consecutive three cycles and a low level is set to the next consecutive three cycles. Another thinning gate signal may be generated which has a low level only at m cycles of arbitrary n cycles. In this specification, a thinning gate signal having a low level only at m cycles in arbitrary n cycles is called as having a thinning ratio m/n.

The thinning gate signal C is supplied from the thinning interval setting circuit 33 to one input terminal of the gate circuit 34, and the sinusoidal wave A is supplied from the sinusoidal wave generator 31 to the other input terminal of the gate circuit. The sinusoidal wave is outputted at the output terminal of the gate circuit 34 only while the thinning gate signal C takes the high level, and is not outputted while the signal C takes the low level. A sinusoidal wave D periodically thinned is therefore outputted at the output terminal of the gate circuit 34, as shown in FIG. 4.

The output terminal of the gate circuit 34 is connected to the DC servo amplifier 35 so that the periodically thinned sinusoidal wave D is inputted to the amplifier 35. The DC servo amplifier 35 amplifies the periodically thinned sinusoidal wave D and supplies it to the compressor 11 (shown in FIG. 2A) of the radiation detection unit 10.

While the sinusoidal wave is supplied to the pistons of the compressor 11 shown in FIG. 2A, the pistons are positively given a driving force, and linearly driven. While the sinusoidal wave is not supplied, a driving force is not given and the pistons enter generally a still state at a neutral position although they slightly oscillate by the force of inertia. Microphonic noise signals generated by the radiation detecting semiconductor element are large while the pistons are driven, and small while the pistons enter the still state at the neutral position.

Since the pistons do not stop immediately after the driving power is suspended, the effective period while the pistons stop is shorter than the period while the driving power is suspended. The effective period while the pistons stop can therefore be prolonged by setting the thinning ratio to 1/2 to n/2n (where n is an integer of 2 or larger).

As shown in FIG. 4, a microphonic noise signal H becomes large after a certain time delay from a moment when the thinning gate signal C rises, and becomes small after a certain time delay from a moment when the thinning gate signal C falls.

The thinning interval setting circuit 88 generates a thinning signal E which is periodical pulses synchronous with the falling edge of the thinning gate signal C, and supplies it to the delay circuit 41 of the radiation detection signal retrieving unit 40. The delay circuit 41 delays the thinning signal by a predetermined time, and supplies the delayed thinning signal F to the radiation signal gating signal generator 42. It is preferable to make the delay time be equal to a delay time from a moment when the thinning gate signal C falls, to a moment when the microphonic noise signal H becomes small.

The radiation signal gating signal generator 42 generates a radiation detection signal gating signal G which rises synchronously with the delayed thinning signal F and maintains the high level for a predetermined time period. It is preferable to make the time period while the gating signal G maintains the high level, up to a moment immediately before the microphonic noise signal H increases after the thinning gate signal C of the next period rises.

A detection signal outputted from the radiation detecting unit 10 is inputted to the amplifier 60. The amplifier 60 amplifies the detection signal to form a radiation detection signal I, and supplies it to one input terminal of the gate circuit 43. The other input terminal of the gate circuit 43 is inputted with the radiation detection signal gating signal G supplied from the radiation signal gating signal generator 42.

A signal appears at the output terminal of the gate circuit 43 only during the period while the radiation detection gating signal G takes the high level, and no signal appears during the other period. The period while the signal appears generally coincides with the period while the microphonic noise signal H has a low level. In this manner, a radiation detection signal J less affected by microphonic noises can be picked up from the output terminal of the gate circuit 43.

The gate circuit 43 supplies the radiation detection signal J less affected by microphonic noises to the pulse height analyzer 44 to which the radiation detection signal gating signal G is supplied from the radiation signal gating signal generator 42. The pulse height analyzer 44 receives the radiation detection signal J from the gate circuit 43 only during the period while the radiation detection signal gating signal G takes the high level, and analyzes the pulse height.

Figure 5:
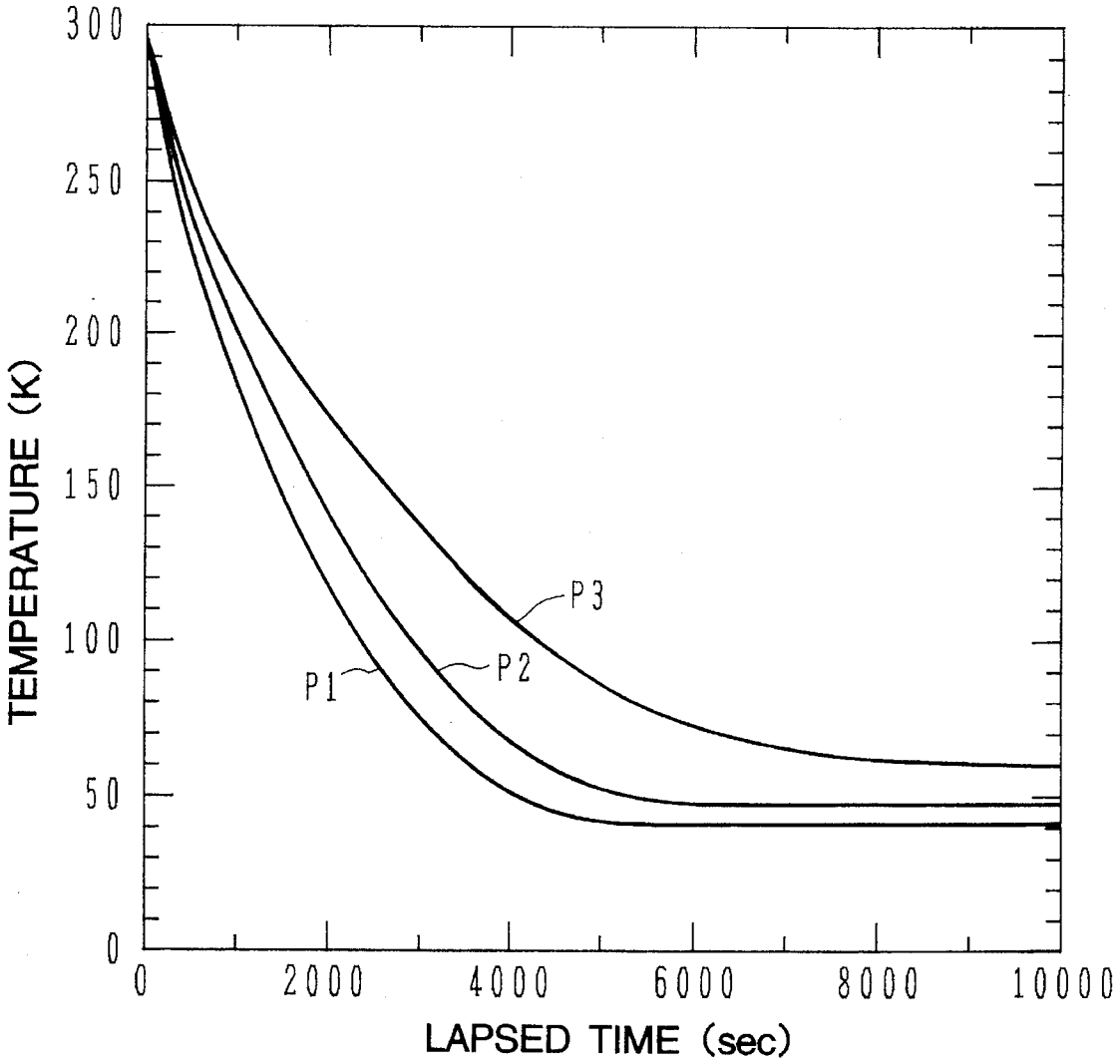
FIG. 5 is a graph showing a cooled temperature change with a lapsed time, for a Stirling refrigerator of the radiation detecting device shown in FIG. 1.

FIG. 5 shows a temperature change of the cooling part of the radiation detecting device shown in FIG. 1 relative to a lapsed time after the start of cooling. The abscissa represents a lapsed time after the start of cooling in the unit of second, and the ordinate represents a temperature of the cooling part in the unit of K. In FIG. 5, curves p1, p2, and p3 correspond to the case without thinning a sinusoidal wave driving power, the case with a thinning ratio of 1/10, and the case with a thinning ratio of 1/4, respectively. A driving voltage of 11 V was used for all the cases.

Although the cooling speed lowers as the thinning ratio is increased, the temperature of the cooling part was lowered to the liquid nitrogen temperature in about 2 hours (7200 seconds) even with the thinning ratio of 1/4.

Figure 6:
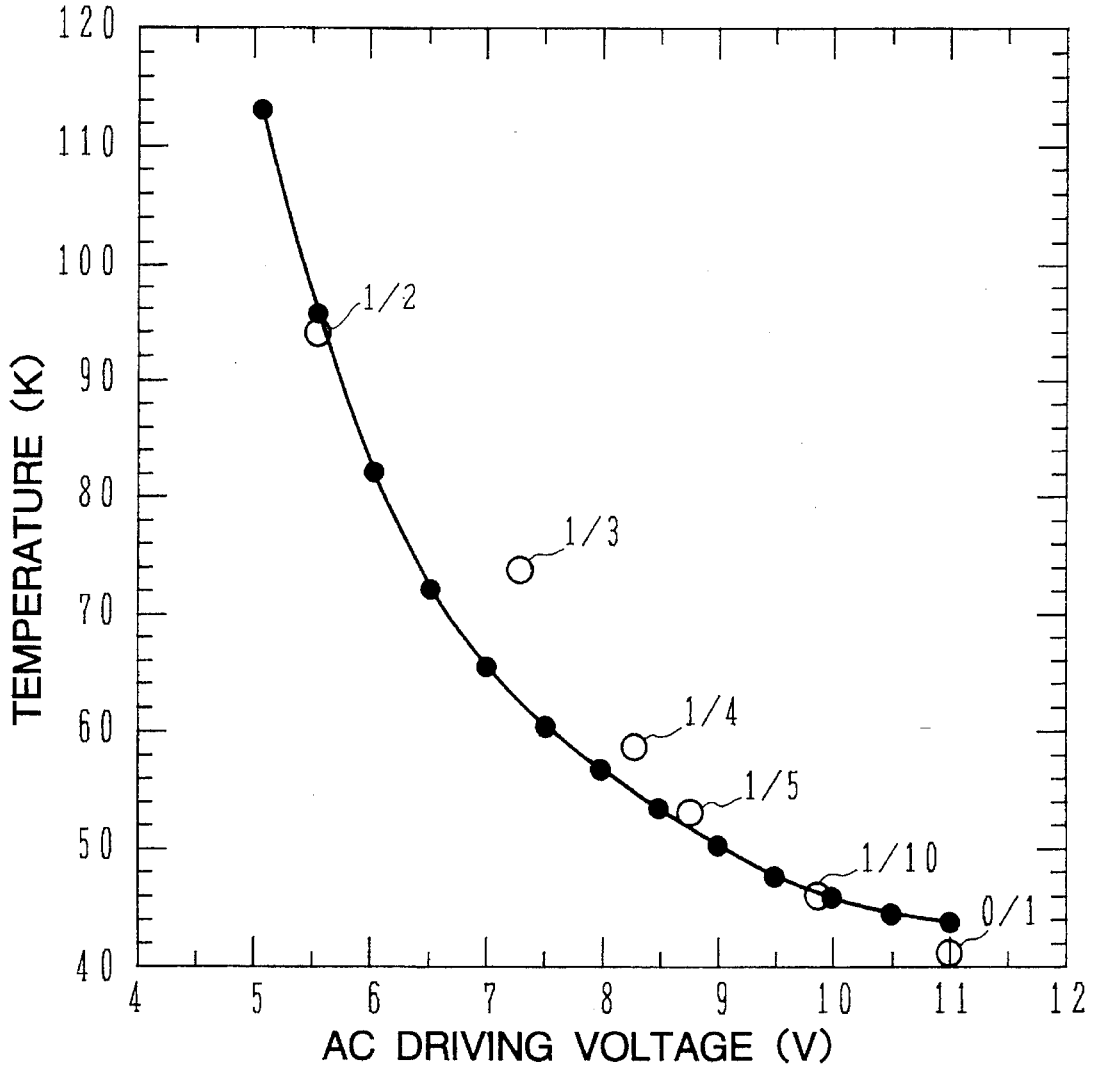
FIG. 6 is a graph showing a cooled temperature relative to an AC driving voltage and a driving power, for the Stirling refrigerator of the radiation detecting device shown in FIG. 1.

FIG. 6 shows temperature changes of the cooling part when an AC voltage of the driving power for the Stirling refrigerator is changed and when the thinning ratio is changed while maintaining the voltage constant. The abscissa represents an AC driving voltage in the unit of V, and the ordinate represents a cooled temperature in the unit of K. FIG. 6, a black (solid) circle represents a cooled temperature when the AC voltage is changed, and a white (hollow) circle represents a cooled temperature when the thinning ratio is changed while maintaining the AC voltage to be 11 V constant. The AC driving voltage for each white circle corresponds to a converted voltage deduced from the thinning ratio. For example, a converted value at a thinning ratio of m/n is $11\times(n-m)/n$. A converted AC driving voltage at the thinning ratio off 1/4 corresponds to $11\times(3/4)=8.25$.

The white circles in FIG. 6 correspond to the thinning ratios of 1/2, 1/3, 1/4, 1/5, 1/10, and 0/1 sequentially in this order from the upper left. The thinning ratio of 0/1 corresponds to the case wherein a sinusoidal wave is supplied for all the periods without thinning it. A cooled temperature at the thinning ratio of 1/2 is about 94 K, as the thinning ratio reduces, the cooled temperature monotonously reduces, and a cooled temperature at the thinning ratio of 1/10 is about 46 K. It is seen that thinning a driving power and changing a voltage have generally the same tendency. A cooled temperature can therefore be controlled by changing a thinning ratio.

Measuring a radiation detection signal at all times by thinning a driving power supplied to the compressor of the Stirling refrigerator will first be described.

Figure 7:
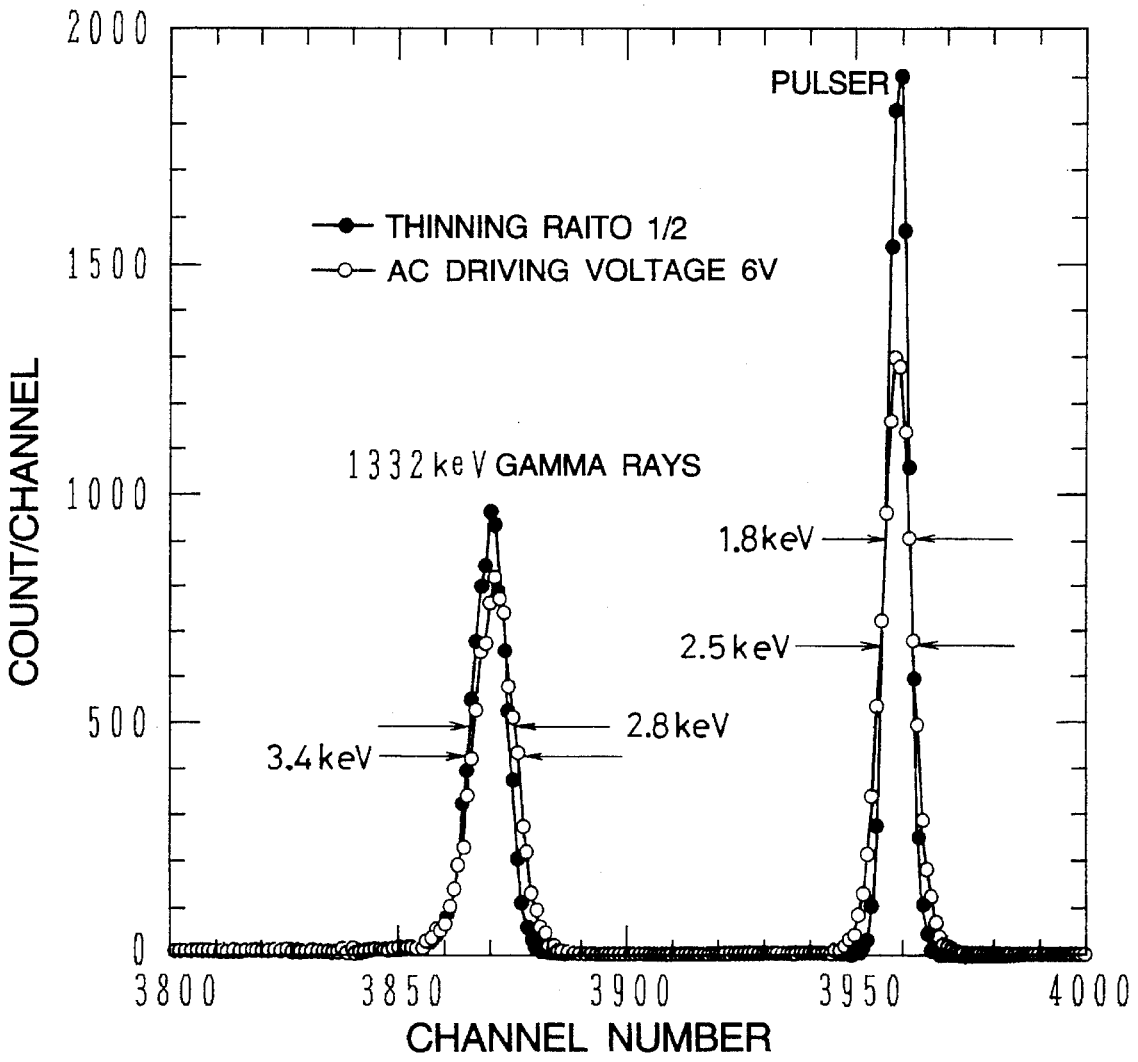
FIG. 7 is a graph showing the characteristics of wave amplitude (pulse height) distribution obtained through measurement of standard gamma rays by thinning or not thinning a supply of a driving power for the Stirling refrigerator of the radiation detecting device shown in FIG. 1.

FIG. 7 shows the characteristics of pulse height distribution obtained by measuring 1.33 MeV gamma rays by using a $^{60}$Co standard gamma ray source and the radiation detecting device of the above-described embodiment. The characteristics of pulse height distribution of a pulser signal inputted at tile same time to the preamplifier front stage circuit 18 shown in FIG. 2A were also measured. The abscissa represents a channel number, and the ordinate represents the number of counts per channel. In FIG. 7, a black circle represents the case with a thinning ratio of 1/2 at an AC driving voltage of 11 V, and a white circle represents the case of a driving voltage of 6 V without thinning. It is seen from FIG. 6 that generally the same cooled temperatures are obtained for both the thinning ratio of 1/2 and an AC driving voltage of 6 V.

A peak of standard gamma rays appears near at the channel number 3870, and a peak of a pulser signal appears near at the channel number 3960. A half-width (band width at half maximum) of the pulse height distribution characteristics of standard gamma rays is 3.4 keV at the AC driving voltage of 6 V, and is improved to 2.8 keV at the thinning ratio of 1/2. A half-width of the pulse height distribution characteristics of the pulser signal inputted at the same time is improved from 2.5 keV to 1.8 keV.

Figure 8:
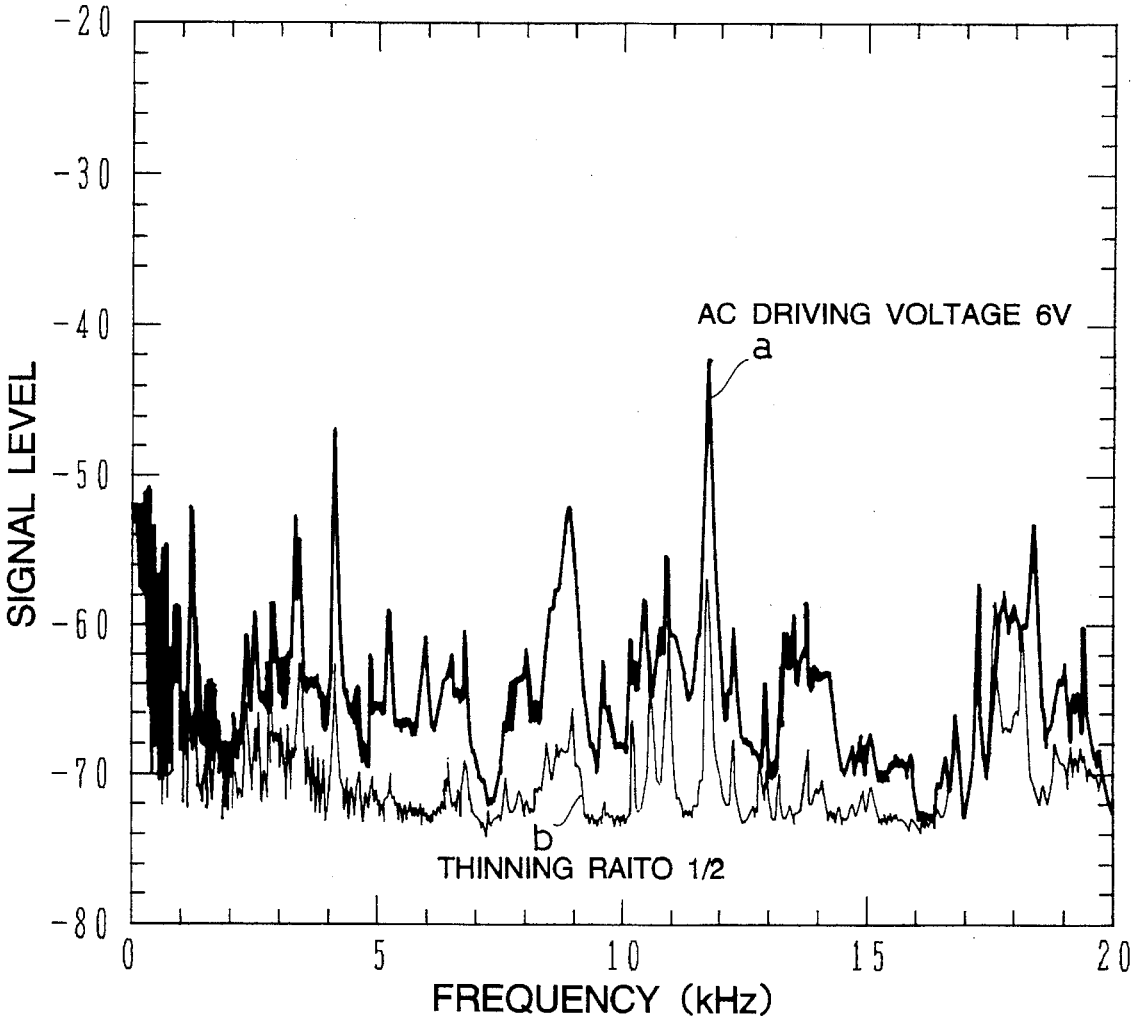
FIG. 8 is a graph showing microphonic noise levels obtained by thinning or not thinning driving power for the Stirling refrigerator of the radiation detecting device shown in FIG. 1.

FIG. 8 shows the spectrum analyzer measurement results of microphonic noises in an output from the amplifier of the radiation detecting device shown in FIGS. 1 and 3. An output signal exists during all the periods because it is a signal upstream of the gate circuit 43. The abscissa represents the frequency in the unit of kHz, and the ordinate represents a signal level in an arbitrary scale. A curve a shows the case with the AC driving voltage of 6 V, and a curve b shows the case with the voltage of 11 V at a thinning ratio of 1/2.

It is understood that the microphonic noise level is reduced when a driving power is thinned, compared to the case with the voltage of 6 V and that this effect is great particularly at a frequency range of 15 kHz or lower. By driving the compressor with a thinned driving power in this way, microphonic noises can be reduced even when the measurement periods are synchronized with the driving power thinning periods.

The case of measuring an output J of the gate circuit 43 only during the period while a microphonic noise signal is small such as shown in FIG. 4 will be next described.

Figure 9:
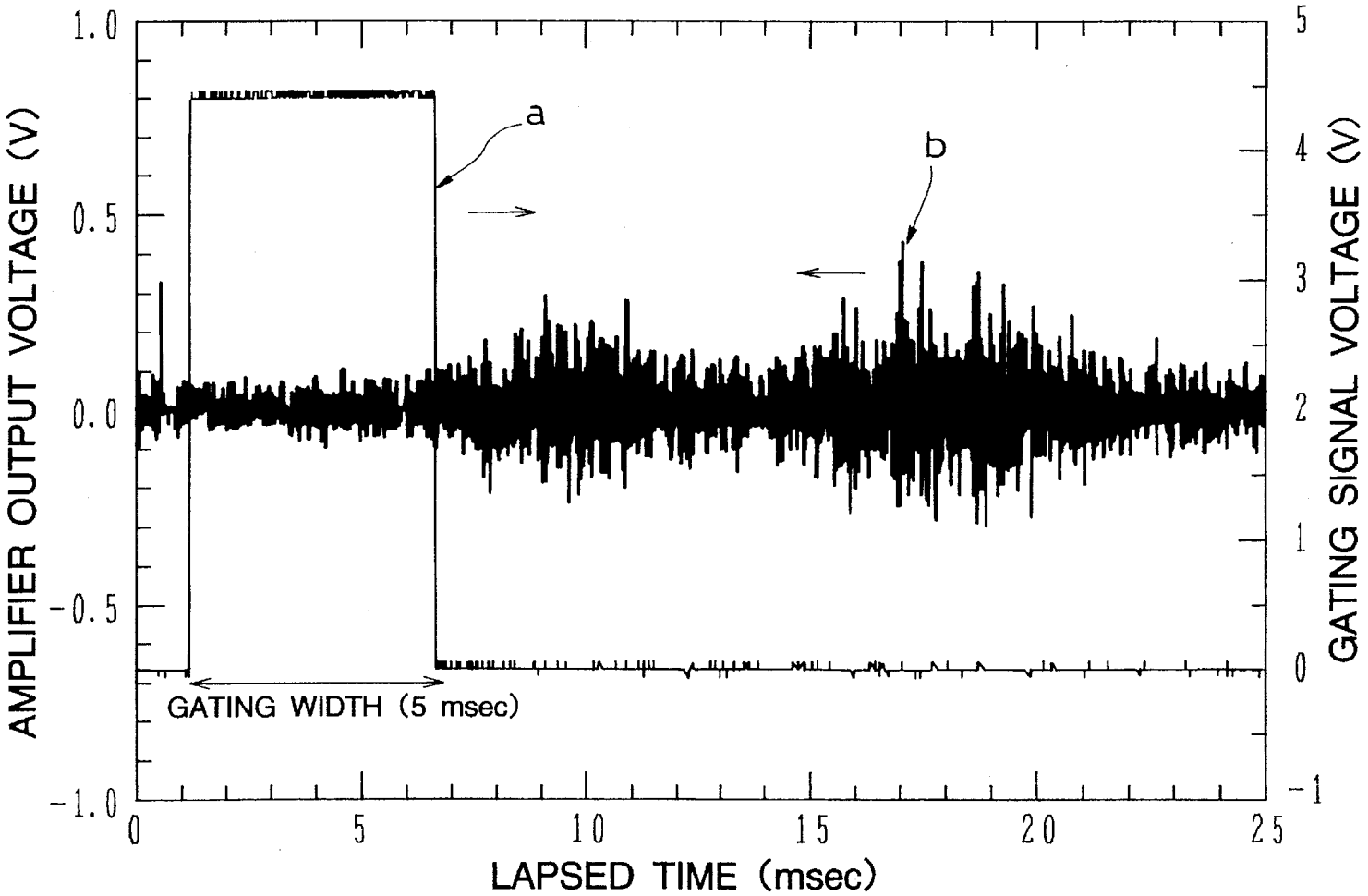
FIG. 9 is a graph showing time dependent changes of microphonic noises obtained by thinning driving power for the Stirling refrigerator of the radiation detecting device shown in FIG. 1 and a gating voltage.

FIG. 9 shows an output voltage of the amplifier 60 shown in FIG. 3 while radioactive rays are not applied and a gate signal voltage outputted from the radiation signal gating signal generator 42. The abscissa represents a lapsed time after an arbitrary time in the unit of msec, the left side ordinate represents an output voltage of the amplifier 60 in the unit of V, and the right side ordinate represents a gate signal voltage in the unit of V. In FIG. 9, a curve a indicates the gate signal voltage and a curve b indicates an output voltage of the amplifier.

During the lapsed time period of 1.2 to 6.7 msec, an output voltage of the amplifier 60, i.e., microphonic noises indicated by the curve b are relatively small. Therefore, only during this period, the gate signal may be set to the high level to open the gate circuit 43 shown in FIG. 3.

Although not shown in the figure, it has been found that microphonic noises become small in about 15 msec after the start of thinning a driving voltage for the compressor. Therefore, the delay time of the delay circuit 41 shown in FIG. 3 was set to 15 msec. The pulse width of the gate signal was set to 5 msec in accordance with the above-mentioned measurement results.

Under these conditions, the characteristics of pulse height distribution were measured in a similar manner as described with FIG. 7. The half-widths of peaks of standard gamma rays and a pulser signal were 2.5 keV and 1.6 keV, respectively. The half-widths became narrower than those of the case where the compressor is driven with a thinned driving power and measurement is made at all times as described with FIG. 7.

The half-widths of standard gamma rays and a pulser signal were 2.5 keV and 1.4 keV when measurement is done while the Stirling refrigerator is completely stopped. This measurement results represent the case when there is no microphonic noise generated by the refrigerator, and are considered to be the characteristics of the same level as the case of measurement under liquid nitrogen cooling. An energy resolution generally of the same level as liquid nitrogen cooling can therefore be obtained by running the compressor with a thinned driving power and carrying intermittent measurement synchronously with the driving power of the compressor.

With the above embodiment, the number of reciprocal motions of the pistons of the Stirling refrigerator can be reduced so that the effects of prolonging the life time of the pump and Stirling refrigerator can also be expected.

Figure 10:
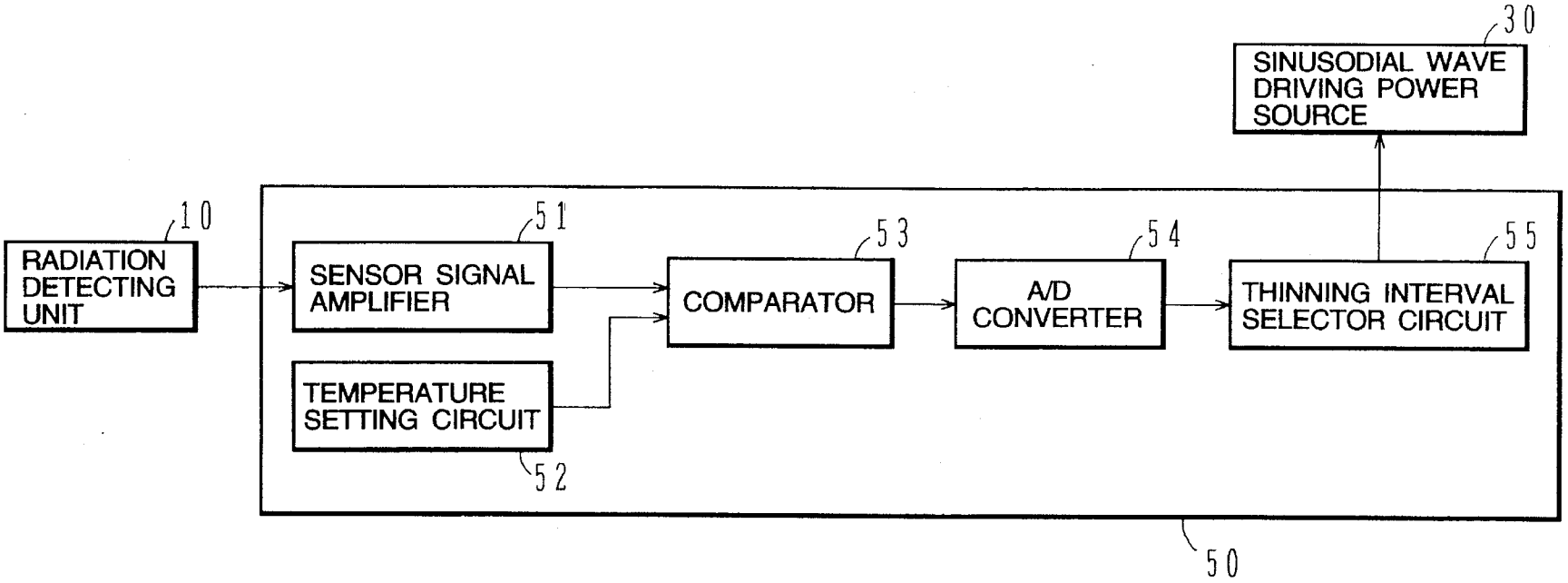
FIG. 10 is a block diagram of a temperature controller of the radiation detecting device shown in FIG. 1.

FIG. 10 is a block diagram of the temperature controller 50 shown in FIG. 1.

A temperature signal outputted from the temperature sensor of the radiation detecting unit 10 is inputted to a sensor signal amplifier 51. The sensor signal amplifier 51 amplifies the temperature signal inputted from the temperature sensor and supplies the amplified temperature signal to one input terminal of a comparator 53. A temperature setting circuit 52 generates a standard temperature signal corresponding to a preset standard temperature and supplies it to the other input terminal of the comparator 53.

The comparator 53 compares the temperature signal inputted from the sensor signal amplifier 51 with the standard temperature signal inputted from the temperature setting circuit 52, and outputs a comparison result. This comparison result is converted into a digital signal by an A/D converter 54, and supplied to a thinning interval selector circuit 55.

The thinning interval selector circuit 55 selects a proper thinning ratio in accordance with the comparison result of the radiation detecting semiconductor element temperature with the standard temperature. For example, if the detected temperature is higher than the standard temperature, the thinning ratio is lowered, whereas if the detected temperature is lower than the standard temperature, it is raised.

The thinning ratio selected by the thinning interval selector circuit 55 is inputted to the thinning interval setting circuit 33 (FIG. 3) of the sinusoidal wave driving power source 30. The thinning interval setting circuit 33 generates a thinning gate signal having a new thinning interval. In this manner, the cooling capacity of the Stirling refrigerator of the radiation detecting device 10 is increased or decreased so that the radiation detecting semiconductor element is maintained at the standard temperature.

In the above embodiment, an AC driving power for the Stirling refrigerator is thinned by an integer multiple of one cycle. The AC driving power may be thinned by an integer multiple of a half cycle. If the AC driving power is thinned each half cycle, only one of positive and negative voltages is outputted from the gate circuit 34. In this case, positive and negative voltages can be alternately outputted by reversing the positive and negative polarities at each cycle.

If an inverter is used, a battery drive can be realized. With the battery drive, outdoor radiation measurement becomes easy. In addition, with a compact device, radiation measurement becomes possible at a location conventionally difficult to measure because of an assembly problem.

In the above embodiment, although a driving power for the compressor is supplied from the DC servo amplifier, other power sources may be used.

Figure 11:
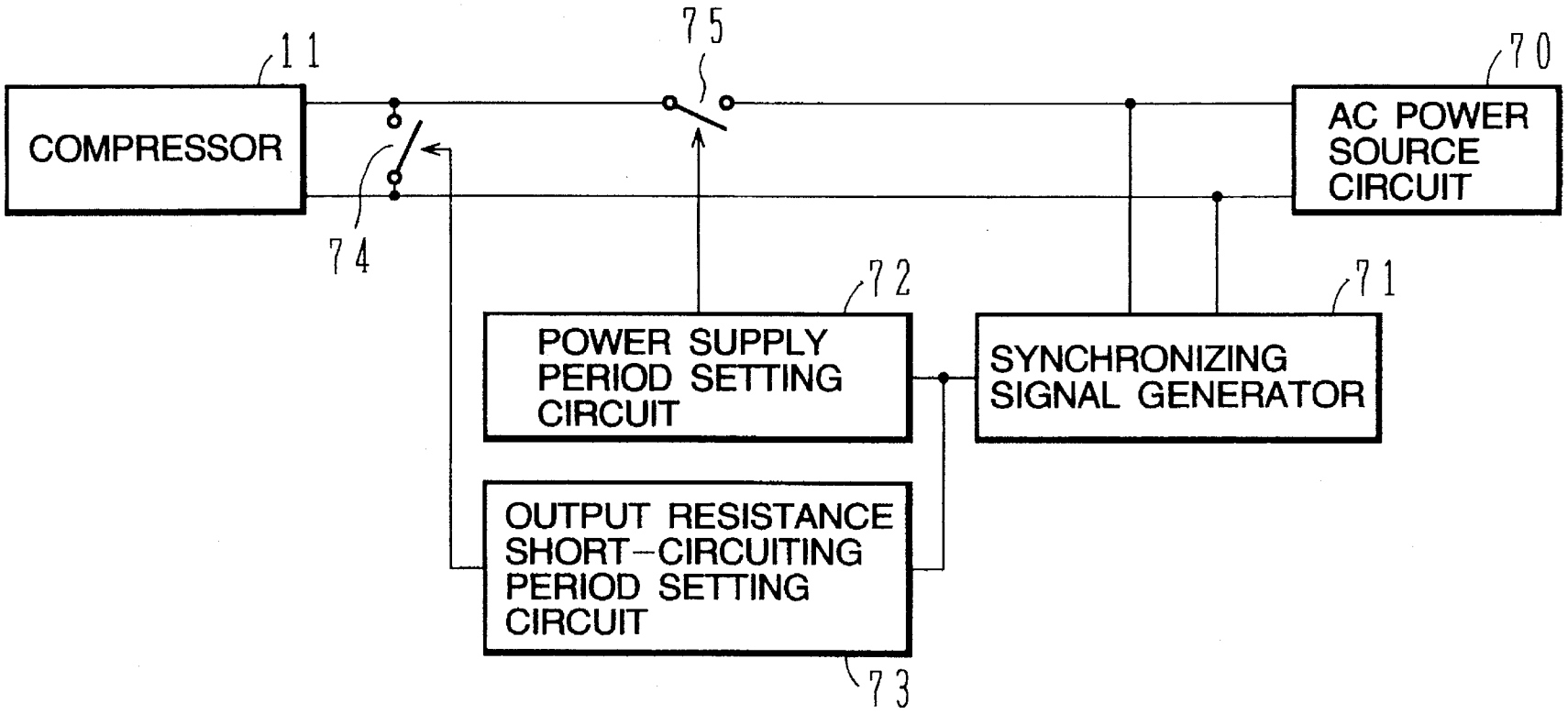
FIG. 11 is a block diagram of a driving power supply system for a compressor according to another embodiment of the invention.

FIG. 11 is a block diagram of a driving power supply system wherein a power supplied to the compressor is turned on and off by a switch. The compressor 11 is connected to an AC power source circuit 70 which generates a sinusoidal wave power having a preset voltage and a preset frequency. A switch 75 is serially connected to the compressor 11, and another switch 74 is connected in parallel to the compressor 11. When the switch 75 is closed, a power is supplied to the compressor. When the switch 74 is closed, power input terminals of the compressor 11 are short-circuited. The switches 74 and 75 are made of triacs or the like.

An output of the AC power source circuit 70 is supplied to a synchronizing signal generator 71 which in turn generates a synchronizing signal synchronous with the power source frequency. The synchronizing signal generated by the synchronizing signal generator 71 is supplied to a power supply period setting circuit 72 and an output resistance shorting period setting circuit 73. The power supply period setting circuit 72 closes the switch 75 only during a preset power supply period. The output resistance shorting period setting circuit 73 closes the switch 74 only during the period while the power is not supplied. The switching timings are controlled so as not to close the switches 74 and 75 at the same time.

As the input terminals of the compressor 11 are short-circuited by closing the switch 74 during the period while the power is not supplied, a braking force is applied to the pistons of the compressor 11. As a result, the pistons can be stopped generally at the neutral position during the period while the power is not supplied.

In the above embodiments, the period of measuring the radiation detection signal is delayed by a predetermined time. Another method of setting the period of measuring the radiation detection signal will be described.

Figure 12:
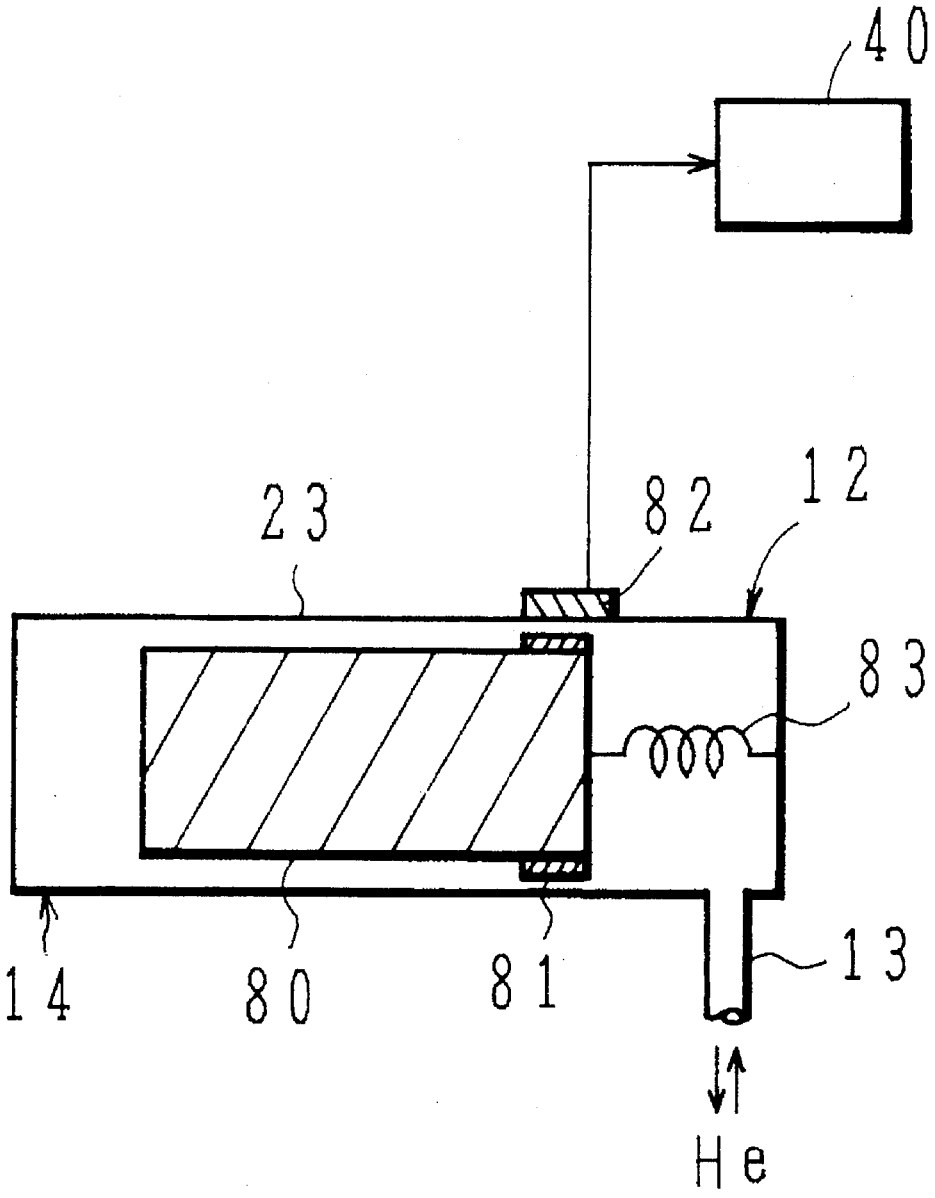
FIG. 12 is a schematic cross sectional view of a cylinder of a Stirling refrigerator according to another embodiment of the invention.

FIG. 12 shows a cross section of a cylinder of a Stirling refrigerator. A displacer 80 having a heat regenerative function is housed in the cylinder 23. The displacer 80 can reciprocally move in the right and left directions as viewed in FIG. 12. Helium gas is adiabatically expanded in a space of the cooling part on the left side of the displacer 80, and isothermally compressed in a space of the isothermal compression part on the right side. The right side end of the displacer 80 is resiliently coupled by a spring 83 to the inner wall of the cylinder 23.

As He gas is transferred via the connection tube 13, the displacer 80 reciprocally moves in the right and left directions as viewed in FIG. 12 at a period delayed by a certain time from the He gas transfer period. When driving of the pistons of the compressor (not shown) is stopped, helium gas is not transferred and the displacer 80 stops generally at an equilibrium position.

A magnet 81 is mounted on the displacer 80 at the right end of its side wall. A magnetic sensor 82 is mounted on the side wall of the cylinder 23 at the position corresponding to the position of the magnet 81 when the displacer 80 is generally at the equilibrium position. An output signal of the magnetic sensor 82 changes with a motion of the displacer 80. As a result, it is possible to check the motion of the displacer 80 from the output signal of the magnetic sensor 82.

The output signal of the magnetic sensor 82 is inputted to the radiation detection signal retrieving unit 40. The gate circuit 43 shown in FIG. 3 of the radiation detection signal retrieving unit 40 is opened while the displacer 80 is almost standstill, and the radiation detection signal is inputted to the pulse height analyzer 44. In this manner, the period of measuring the radiation detection signal may be set by directly detecting the motion of the displacer.

The motion of the displacer may be detected by disposing a pressure sensor in the isothermal compression part 12 or by mounting a piezoelectric sensor on the spring 83.

Figure 13A:
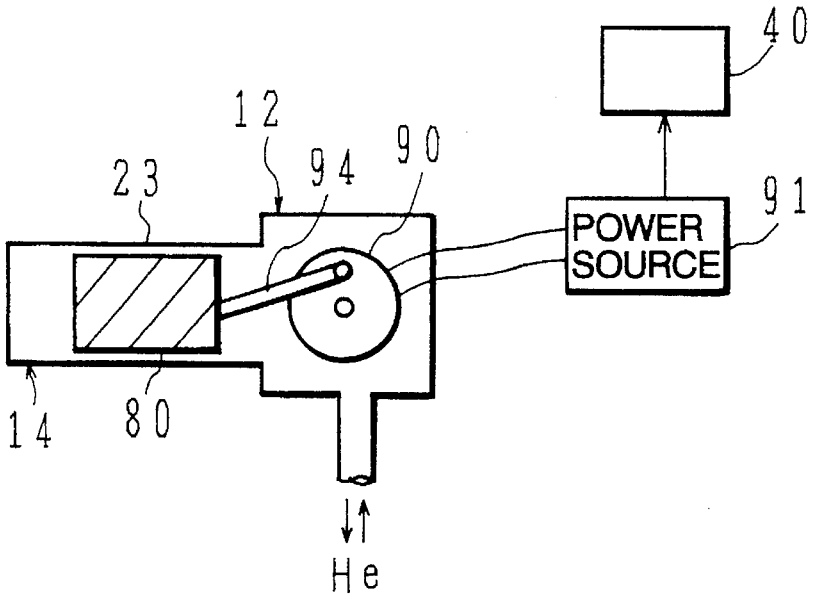
FIGS. 13A and 13B are schematic cross sectional views of cylinders of a Stirling refrigerator according to further embodiments of the invention.
Figure 13B:
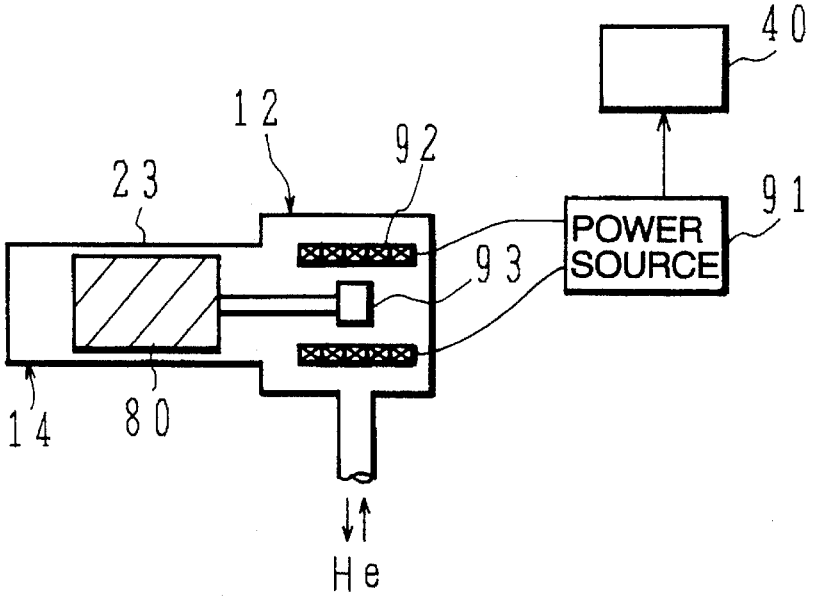
Figure 14:
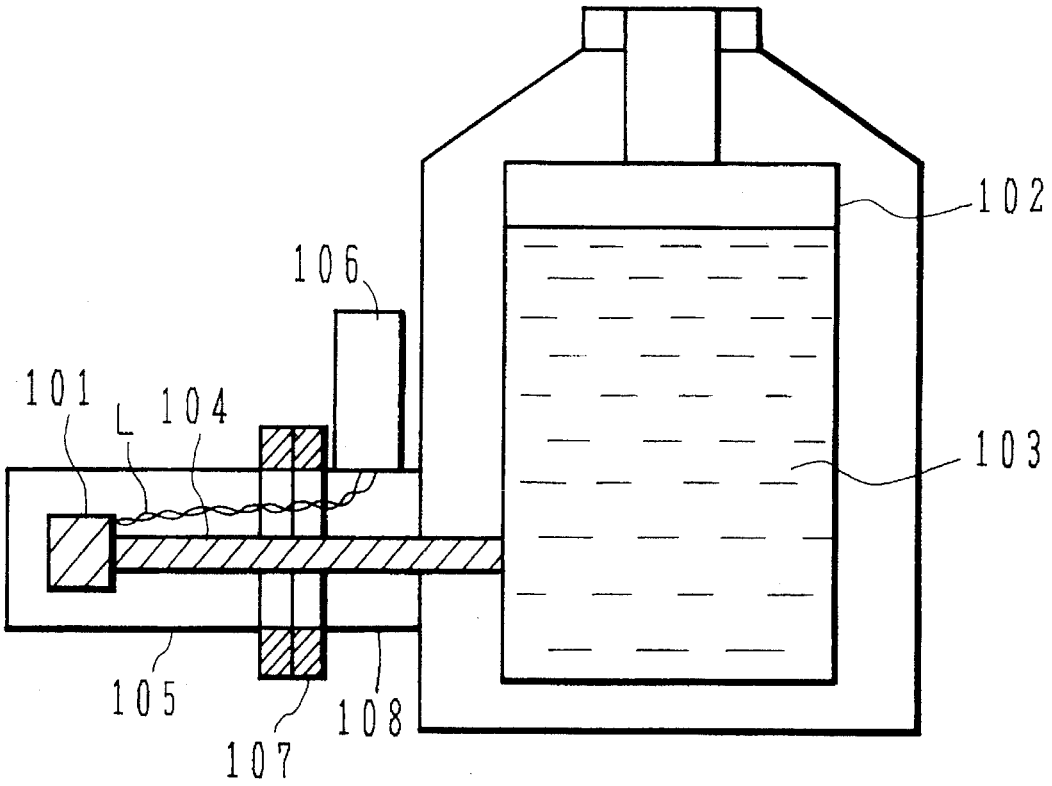
FIG.14 (PRIOR ART)
FIG. 14 is a schematic cross sectional view of a conventional radiation detecting semiconductor device of a liquid nitrogen cooling type.
Figure 15:
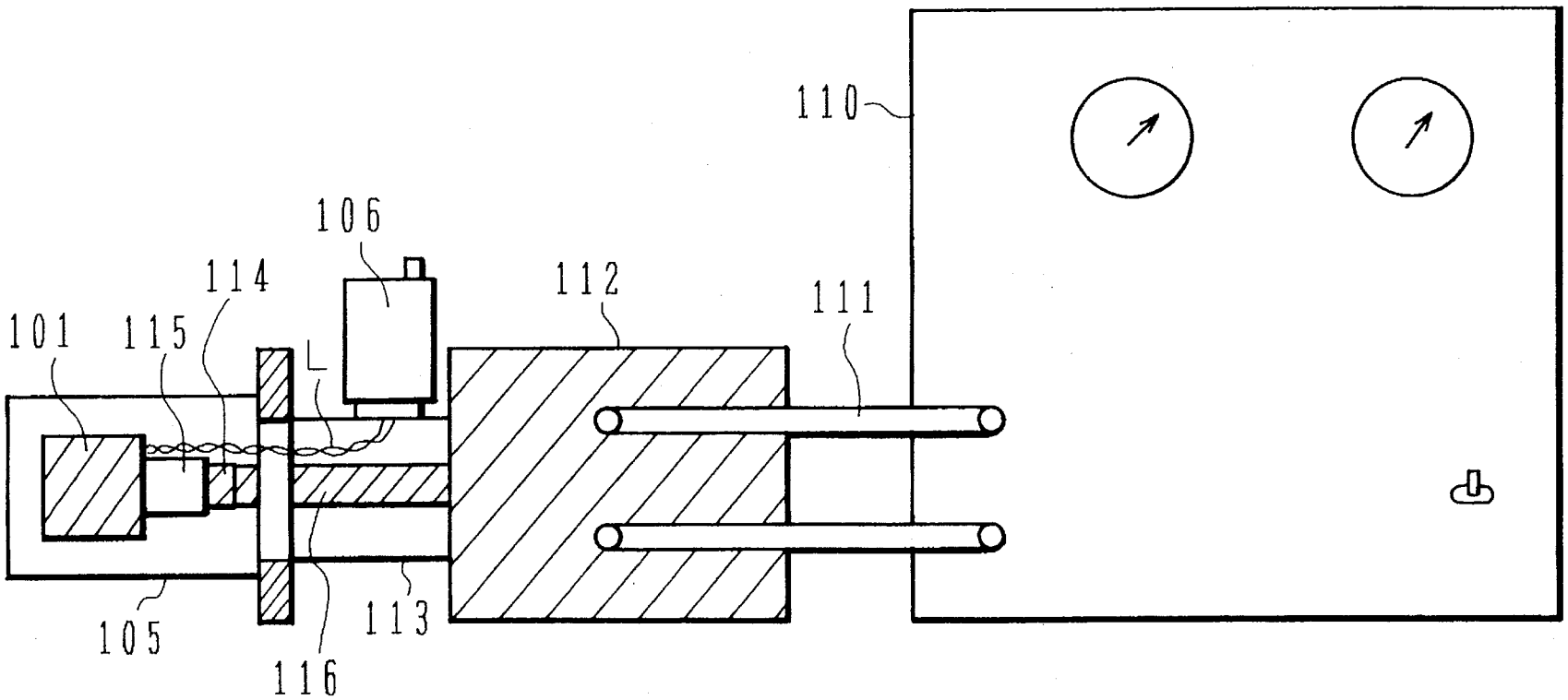
FIG.15 (PRIOR ART)
FIG. 15 is a schematic cross sectional view of a conventional radiation detecting semiconductor device using a closed cycle He cooler.

FIGS. 13A and 13B illustrate examples of positively driving the displacer.

FIG. 13A illustrates an example of driving a displacer 80 by a cam mechanism. The displacer 80 inserted into a cylinder 23 is coupled via a driving rod 94 to a rotary disc 90 in an isothermal compression part 12. A rotary shaft of a motor not shown is coupled to the central point of the rotary disc 90 which revolves on this point. As the rotary disc 90 revolves, the displacer 80 reciprocally moves in the right and eft directions as viewed in FIG. 13A.

A driving power is supplied from a power source 91 to the drive motor of the rotary disc 90. The power source 91 supplies drive information to the radiation detection signal retrieving unit 40. For example, this drive information may be a signal which takes a high level while the motor is driven. As the power source 91 intermittently drives the motor, the displacer repeats reciprocal motion and stop. The same effects as intermittently driving the compressor can be obtained.

The radiation detection signal retrieving unit 40 can detect a stop period of the displacer 80 from the drive information supplied from the power source 91. By measuring the radiation detection signal during this stop period, the same effects as those of the embodiment shown in FIG. 1 can be obtained.

FIG. 13B illustrates an example of linearly driving a displacer 80. A coil 92 is disposed in the isothermal compression part 12 in parallel with the direction of motion of the displacer 80. A magnet 93 coupled to the displacer 80 is inserted in the coil 92. A power is supplied from a power source 91 to the coil 92. The other structures are the same as those of FIG. 13A except the driving mechanism of the displacer 80. The structure shown in FIG. 13B provides similar effects as those of FIG. 13A.

In the above-described embodiments, although a Stirling refrigerator is used, other He gas refrigerators may be used. For example, a pulse tube refrigerator may be used. It is preferable to set a tie gas expansion cycle to 10 Hz to 400 Hz in order to obtain sufficient effects of intermittent drive of the compressor or displacer.

In the above embodiments, although radioactive rays are detected by cooling a radiation detecting semiconductor element, other detectors may be used. For example, an infrared detecting semiconductor element may be used.

In the above embodiments, although a detecting device in which a detecting element is cooled by a refrigerator has been described, the method of driving a refrigerator described in the embodiment may be applied to an electronic device having a different electronic device in place of the detecting element.

The present invention has been described in connection with the preferred embodiments. The invention is not limited only to the above embodiments. For example, it is apparent to those skilled in the art that various substitutions, modifications, improvements, combinations and the like can be made without departing from the scope of the appended claims.

We claim:

1. An electronic device comprising:

a compressor driven by an electric signal, for supplying and recovering He gas at an operation cycle of 10 Hz to 400 Hz;

a He gas refrigerator for transferring said He gas to and from said compressor and expanding said He gas for cooling;

driving power supply means for intermittently supplying a driving power to said compressor at a certain interval; and an electronic element arranged to be cooled by said He gas refrigerator.

2. An electronic device according to claim 1, wherein said driving power supply means forms alternately and periodically a driving period for supplying a driving power to said compressor and a stop period for not supplying a driving power to said compressor.

3. An electronic device according to claim 1, wherein said driving power is an alternating current power having a predetermined frequency.

4. An electronic device according to claim 1, wherein said compressor includes a piston, and a linear motor for driving the piston.

5. An electronic device according to claim 3, wherein said alternating current power has a sinusoidal waveform.

6. An electronic device according to claim 2, wherein said drive period and said stop period each are set to have an integer multiple of a half cycle of said predetermined frequency.

7. An electronic device according to claim 2, wherein said electronic element is a radiation detecting semiconductor element, and the device further comprises detection signal analyzing means for analyzing a radiation detection signal outputted from said radiation detecting semiconductor element only during a certain measurement period after a certain delay time from a start of said stop period.

8. An electronic device according to claim 7, wherein said detection signal analyzing means includes:

delay means for receiving a signal notifying a completion time of said drive period and generating a delay signal which is a signal delayed by said certain delay time; and intermittent analyzing means for receiving the delay signal from said delay means and measuring the radiation detection signal only during said certain measurement period starting from a reception of the delay signal.

9. An electronic device according to claim 7, wherein said certain delay time is generally equal to a time from the completion time of said drive period to a time when microphonic noises generated from said detecting semiconductor element due to vibrations of said He gas refrigerator take a level equal to a reference level or smaller.

10. An electronic device according to claim 2, further comprising:

temperature measuring means for measuring a temperature of said electronic element; and temperature control means for comparing a measurement result by said temperature measuring means with a preset standard temperature and determining time durations of said drive period and said stop period in accordance with a comparison result, wherein said driving power supply means outputs the driving power in accordance with said driving period and said stop period determined by said temperature control means.

11. An electronic device according to claim 1, wherein said He gas refrigerator is a Stirling refrigerator, and said electronic element includes a radiation detecting semiconductor element mounted on a cooling part of said Stirling refrigerator, and the device further comprises:

displacer stop detecting means for detecting that a reciprocal motion of the displacer of said Stirling refrigerator comes to almost a standstill; and detection signal analyzing means for analyzing a radiation detection signal outputted from said radiation detecting semiconductor element only during a period corresponding to a period while the reciprocal motion of the displacer comes to almost a standstill.

12. An electronic device according to claim 11, wherein said displacer stop detecting means includes:

a magnetic member mounted on the displacer; and a magnetic sensor mounted on a cylinder in which the displacer is inserted.

13. An electronic device according to claim 1, wherein said driving power supply means includes:

a sinusoidal wave generator for outputting a sinusoidal wave signal;

a thinning interval setting circuit for outputting a thinning gate signal synchronously with the sinusoidal wave signal outputted from said sinusoidal wave generator, said thinning gate signal repetitively taking a first voltage and a second voltage at a constant period; and a gate circuit having two input terminals, one input terminal being supplied with the sinusoidal wave signal outputted from said sinusoidal wave generator and the other input terminal being supplied with said thinning gate signal, said gate circuit outputting the sinusoidal wave signal supplied to the one input terminal only during a period while said thinning gate signal takes said first voltage.

14. An electronic device according to claim 13, wherein said driving power supply means further includes an amplifier for amplifying a signal outputted from said gate circuit and supplying the amplified signal to said compressor.

15. An electronic device comprising:

a Stirling refrigerator including a displacer, for expanding He gas at an operation cycle of 10 Hz to 400 Hz;

drive means for reciprocally driving the displacer of said Stirling refrigerator;

a driving power source for intermittently supplying a driving power to said drive means; and an electronic element thermally coupled to said Stirling refrigerator.

16. An electronic device according to claim 15, wherein said electronic element is a radiation detecting semiconductor element, and the device further comprises detection signal analyzing means for analyzing a radiation detection signal outputted from said radiation detecting semiconductor element only during a period which corresponds to a period while a power is not supplied from said driving power source.

17. A detecting method wherein a detector is mounted on a cooling part of a refrigerator having a movable part to be forcibly driven, the detector outputting a detection signal corresponding to an externally inputted object to be measured, the detector is cooled, and the detection signal outputted from the detector is analyzed, the method comprising the steps of:

driving said refrigerator and cooling said detector;

stopping driving of said refrigerator and analyzing the detection signal outputted from said detector; and repeating said cooling step and said analyzing step at a certain periodical cycle.

18. A detecting method according to claim 17, further comprising the steps off:

measuring a temperature of said detector; and changing time durations of a period of said cooling step and a period of said analyzing step in accordance with a temperature of said detector.

19. A detecting method according to claim 17, further comprising the step of detecting that the movable part of said refrigerator comes to almost a standstill, after said cooling step, wherein said analyzing step analyzes the detection signal, after said seep of detecting that the movable part comes to almost a standstill detects that the movable part comes to almost a standstill.

* * * * *

UNITED STATES PATENT AND TRADEMARK OFFICE

CERTIFICATE OF CORRECTION

PATENT NO. : 5,531,074

DATED : July 2, 1996

INVENTOR(S) : Masaki KATAGIRI et al.

It is certified that error appears in the above-indentified patent and that said Letters Patent is hereby corrected as shown below:

Title Page, Item [57], ABSTRACT, line 5, "tie" should be --He--.

Signed and Sealed this

Seventeenth Day of December, 1996

*Attest:*

*Attesting Officer*

Bruce Lehman

BRUCE LEHMAN

*Commissioner of Patents and Trademarks*